United States Patent [19]

Katzman et al.

[11] 4,345,400

[45] Aug. 24, 1982

[54] PLUSH BANK

[75] Inventors: Allison W. Katzman; Edward T. Holahan; John V. Zaruba, all of Chicago; Howard J. Morrison, Deerfield, all of Ill.

[73] Assignee: Marvin Glass & Associates, Chicago, Ill.

[21] Appl. No.: 212,348

[22] Filed: Dec. 3, 1980

[51] Int. Cl.[3] ..... A63H 33/00

[52] U.S. Cl. ..... 46/4; 46/141

[58] Field of Search ..... 46/141, 2, 3, 4, 5, 46/158

[56] References Cited

U.S. PATENT DOCUMENTS

| | | | |
|---|---|---|---|
| 2,114,167 | 4/1938 | Grauer | 46/3 X |
| 2,572,795 | 10/1951 | Wood et al. | 46/141 |
| 3,295,247 | 1/1967 | Lerner | 46/4 |
| 3,831,313 | 8/1974 | Cichy | 46/158 X |
| 3,841,017 | 10/1974 | Heble | 46/4 |
| 4,050,183 | 9/1977 | Watanbe | 46/4 |
| 4,192,092 | 3/1980 | Goldfarb et al. | 46/141 X |

*Primary Examiner*—Robert Peshock
*Assistant Examiner*—Mickey Yu
*Attorney, Agent, or Firm*—McDermott, Will & Emery

[57] ABSTRACT

An amusement device of the present invention comprises a bank constructed in the form of a plush doll having a coin insert aperture in the facial area, such as the mouth, leading to an internal coin receptacle. A pawl and ratchet mechanism is disposed within the doll to prevent coins inserted in the doll from completely entering the coin receptacle until the pawl and ratchet mechanism is manually activated by pushing or squeezing a predetermined area of the doll, thereby rotating a ratchet wheel to force the coins into the coin receptacle and simultaneously causing pivotal movement of a face distorting member so that it appears as if the doll is chewing the coin.

17 Claims, 5 Drawing Figures

Fig 1
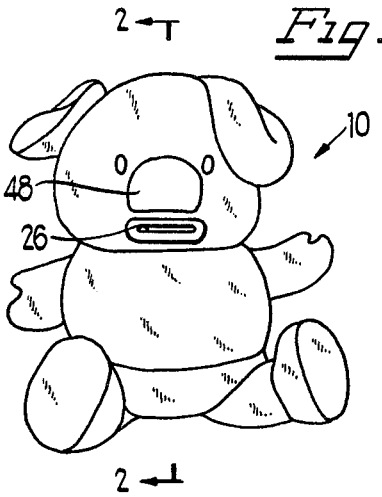
Fig 5
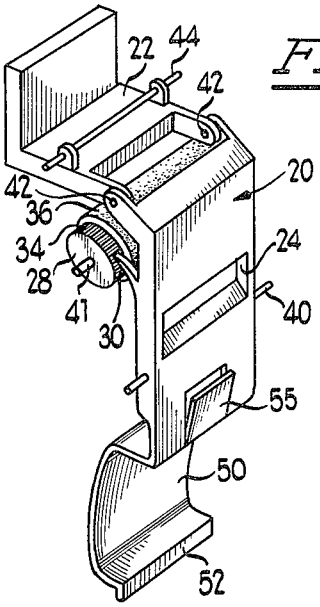
Fig 2
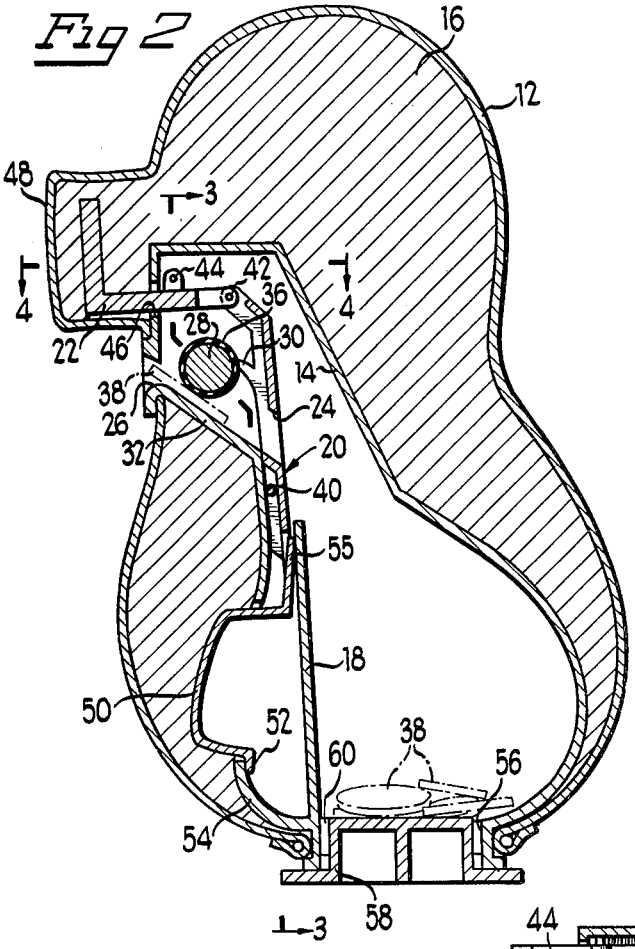
Fig 3
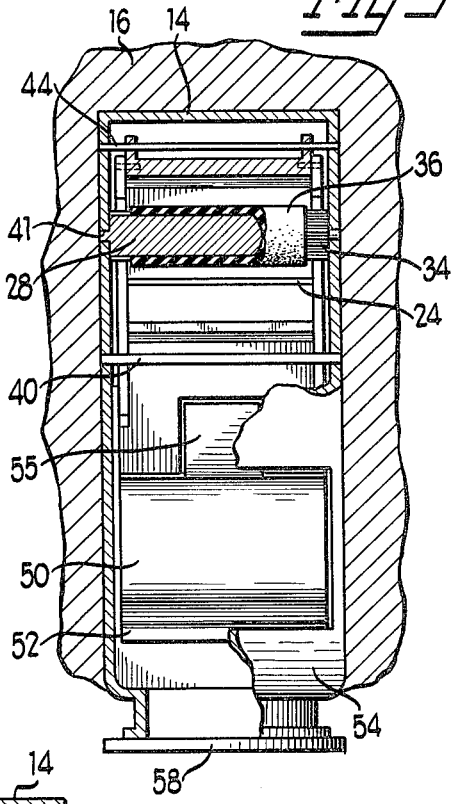
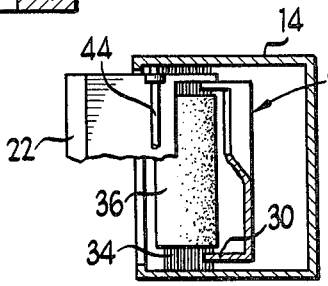
Fig 4

PLUSH BANK

BACKGROUND OF THE INVENTION

1. Field of the Invention

The present invention relates to an amusement device and more particularly to a bank-type amusement device in the form of a plush doll or animal.

2. Brief Description of the Prior Art

Toy banks, for example in the form and shape of animals, such as the common "piggy bank" have been known for many years. Many of such banks have been constructed in the form of an amusement device or game requiring a particular manual manipulation before the bank will completely accept a coin into a coin receptacle. Such amusement type games associated with a bank to provide an amusing or entertaining course of travel for the coins have been known for many year, for example, as disclosed in the Morrison et al. U.S. Pat. No. 4,198,778.

Additionally, dolls and other toys have been provided with internal mechanisms, operated manually or electrically, which cause the doll or toy to change facial expressions.

The present invention relates to a bank-type amusement device in the form of a toy animal requiring a manual squeezing force in the animal's body for the coin to be completely accepted within a coin receptacle. The squeezing action simultaneously causes distortions in the animal's facial area, simulating a chewing action.

SUMMARY OF THE INVENTION

An object of the present invention is to provide a new and improved amusement device in the form of a toy bank.

Another object of the present invention is to provide a new and improved amusement device in the form of a toy bank constructed in the shape of a plush doll. Another object of the present invention is to provide a new and improved amusement device in the form of a toy bank wherein coins inserted into an aperture in the toy bank will not be completely accepted to fall within a coin receptacle until a predetermined area of the toy is pushed or squeezed to force the coin into the coin receptacle and at the same time causing distortion of a predetermined area of the toy bank, for example, facial distortion simulating a chewing action.

In brief, the amusement device of the present invention comprises a plus doll having a coin insert aperture in the facial area, such as the mouth, leading to an internal coin receptacle; a pawl and ratchet mechanism disposed within the doll to prevent coins inserted in the doll from completely entering the coin receptacle until the pawl and ratchet mechanism is manually activated by pushing or squeezing a predetermined area of the doll, thereby rotating a ratchet wheel to force the coins into the coin receptacle and simultaneously pivoting a face distorting member so that it appears as if the doll is chewing the coin.

BRIEF DESCRIPTION OF THE DRAWING

FIG. 1 is a perspective view of the toy bank amusement device of the present invention formed in the shape of a plush doll;

FIG. 2 is an enlarged, cross-sectional view taken along line 2—2 of FIG. 1;

FIG. 3 is a fragmentary, partially elevational, cross-sectional view taken along the line 3—3 of FIG. 2;

FIG. 4 is a fragmentary, partially elevational, cross-sectional view taken along the line 4—4 of FIG. 2; and FIG. 5 is an enlarged, perspective view of a pawl and ratchet mechanism and connected face distorting member portions of the amusement device of the present invention.

DETAILED DESCRIPTION OF THE PREFERRED EMBODIMENT

Turning now to the drawing there is illustrated a new and improved bank-type amusement device generally designated by reference numeral 10. The amusement device 10 generally comprises a doll shaped outer housing 12 surrounding an inner housing or coin receptacle 14 the intermediate space being stuffed or filled with a distortable filling material 16 between the outer and inner housing 12 and 14, respectively. In a preferred embodiment, the outer housing 12 is made of a resilient cloth material to form a plush doll.

The inner housing or coin receptacle 14 includes an upstanding J-shaped wall 18 for positioning an interior pawl and ratchet mechanism 20 and a pivotally connected L-shaped face distorting member 22. The pawl and ratchet mechanism 20 is disposed within the doll to align a coin receiving aperture 24 of the pawl and ratchet mechanism 20 with a coin receiving aperture 26 in the exterior of the doll 10, as shown in FIG. 2. A grooved rachet wheel 28 and pawl 30 of the pawl and ratchet mechanism 20 are disposed between the exterior coin receiving aperture 26 and the interior coin receiving aperture 24 of the pawl and ratchet mechanism 20 so as to intercept a coin inserted in the exterior coin receiving aperture 26 to prevent the coin from sliding along an upper surface of a coin slide member 32 through the interior coin receiving aperture 24 of the pawl and ratchet mechanism 20 so that the coin cannot initially fall within the interior coin receptacle 14.

The ratchet wheel 28, of the pawl and ratchet mechanism 20, is an elongated cylindrical member having pawl receiving grooves 34 completely encircling the cylinder at both of its extremities, as shown in FIG. 5. The ratchet wheel 28 is wrapped with a suitable resilient, compressible material, such as polyurethane foam 36, between the grooves 34 on the extremities of the ratchet wheel 28, to squeeze and hold a coin 38 between the foam material 36 and an upper surface of the coin slide 32, as shown in FIG. 2, initially to prevent the coin from sliding into the coin receptacle 14. A suitable thickness, i.e., $\frac{1}{8}$–$\frac{1}{4}$ inch, of foam material 36 on the exterior of ratchet wheel 28 enables the ratchet wheel 28 to hold coins 38 of any thickness between the ratchet wheel 28 and the upper surface of coin slide 32. The pawl and ratchet mechanism 20 is pivotally secured within the interior of the doll 10 by a pivot pin 40 extending transversely through the pawl and ratchet mechanism 20 and pivotally journalled into the inner housing or coin receptacle 14. The ratchet wheel 28 is secured to the inner housing or coin receptacle by central axle 41 pivotally journalled into the inner housing or coin receptacle 14, as shown in FIG. 3.

The L-shaped face distorting member 22 is pivotally secured to the inner housing or coin receptacle 14 by journalling a connecting pivot pin 44 into the inner housing, as best shown in FIG. 3. The face distorting member 22 is pivotally connected to the pawl and ratchet mechanism 20 at an upper extremity of pawl and ratchet mechanism 20 by one or more suitable hinge pins 42 (FIG. 5) so that any downward angular movement of the pawl and ratchet mechanism 20 at the hinge pins 42 causes a corresponding upward angular rotation of the face distorting member 22 about the pivot pin 44 causing facial distortion in the doll 10. The L-shaped face distorting member 22 extends through an aperture 46 in the inner housing or coin receptacle into a suitable face portion of the doll 10, such as the nose portion 48 of teddy bear shaped plush doll 10. It is understood that the face distorting member 22 can be formed in any desired shape to accommodate any suitable face portion of a particularly shaped plush doll 10 to cause a desired facial distortion when the face distorting member 22 is pivoted about the pivot pin 44.

Once the coin 38 is caught between the exterior foam material 36 of ratchet wheel 28 and the upper surface of the coin slide 32, as shown in FIG. 2, the ratchet wheel 28 must be turned in a counterclockwise direction to force the coin 38 into the coin receptacle 14. This is accomplished by pushing inwardly on the doll 10 at a lower portion of the doll to force a lower extremity of the pawl and ratchet mechanism 20 inwardly toward the center of the doll 10 so that the pawl and ratchet mechanism 20 is pivoted about pivot pin 40. This action forces the flexible pawl 30, caught within a groove 34 on ratchet wheel 28, upwardly to turn the ratchet wheel 28 in a counterclockwise direction to push the coin 38 closer toward the coin receiving aperture 24 in pawl and ratchet mechanism 20. Generally, this action must be repeated a number of times in order to force the coin 38 entirely past the ratchet wheel 28 and through the coin receiving aperture 24 in pawl and ratchet mechanism 20 so that the coin drops into the coin receptacle 14. The pawl and ratchet mechanism includes a U-shaped extension arm 50 at its lower extremity to dispose the lower extremity of the pawl and ratchet mechanism 20 close to a front surface of the outer doll shaped housing 12 so that by pushing in on the front surface of the outer doll shaped housing 12 adjacent to the U-shaped extension arm 50, suitable force will be transmitted through the intermediate filling material 16 to the U-shaped extension arm 50 to cause the paul and ratchet mechanism 20 to pivot about the pivot pin 40 thereby forcing the coin 38 into the coin receptacle and causing a corresponding pivotal motion of the face distorting member 22 about pivot pin 44. The U-shaped extension arm 50 includes a transversely extending leg 52 so that when a compressive force is removed from the U-shaped extension arm 50 to cause this portion of the pawl and ratchet mechanism 20 to return to its original position, the extending leg member 52 acts as a stop against the curved portion 54 of J-shaped wall member 18 to ensure that the pawl and ratchet mechanism 20 returns to its original position after each compressive forcing action.

The pawl and ratchet mechanism 20 is spring biased toward the front portion of the doll 10 in a position shown in FIG. 2 by providing a U-shaped cutout extending portion 55 (FIG. 5) of pawl and ratchet mechanism 20 compressed against the upper extremity of J-shaped wall member 18 to spring bias the pawl and ratchet mechanism 20 into the position shown in FIG. 2. The coin receptacle 14 includes an access opening 56 for coin removal, closed by a removable receptacle cover 58 mounted within the coin receptacle 14, with a bayonet type mount 60 on opposite sides of the cover 58, fitting into slots in the coin receptacle 14.

What is claimed is:

1. A toy bank comprising:

an outer, inwardly displaceable housing in the form of a plush animate figure including means for receiving tokens, such as money or the like;

a tokens receptacle disposed within said bank for storing a quantity of tokens;

passage means to direct said tokens from said outer housing to said tokens receptacle;

means, disposed within said outer housing along said passage means, for engaging said tokens temporarily to prevent said tokens from being received within said tokens receptacle;

means for moving said tokens past said engaging means to permit said tokens to be received by said tokens receptacle and an inner housing including a flexible upstanding wall defining a portion of said coin receptacle, said means for engaging said tokens comprises a pawl and ratchet mechanism comprising a pawl extending from an interior frame member, said pawl adapted to engage a ratchet mechanism on said token engaging means so that actuation of said pawl against said ratchet mechanism causes rotation of said token engaging means, said frame member includes token receiving means defining a portion of said passage means, said token receiving means on said frame member adapted to remain in alignment along said passage means during actuation of said pawl and ratchet mechanism.

2. A toy bank as defined in claim 1 further including means for distorting a predetermined area of said bank, said distorting means being operatively connected to said means for moving said tokens past said token engaging means so that actuation of said token moving means simultaneously causes distortion of said predetermined area of said bank.

3. A toy bank as defined in claim 1, wherein said means for engaging said tokens comprises an elongated wheel disposed transversely along said passage means to frictionally engage said tokens so that said tokens cannot proceed into said tokens receptacle until said wheel is turned to move said tokens past said wheel.

4. A toy bank as defined in claim 3 wherein said token moving means comprises a pawl adapted to engage said elongated wheel to turn said wheel to force said token past said wheel.

5. A toy bank as defined in claim 4 wherein said pawl is rotatable within said bank such that rotation of said pawl causes rotation of said elongated wheel.

6. A toy bank as defined in claim 5 wherein said elongated wheel includes a plurality of grooves adapted to be engaged by said pawl.

7. A toy bank as defined in claim 5 wherein said pawl extends from a rotatable elongated frame member.

8. A toy bank as defined in claim 7 further including means for causing movement in a predetermined area of said outer housing, said outer housing moving means being operatively connected to said token moving means such that actuation of said token moving means causes simultaneous movement of said outer housing.

9. A toy bank as defined in claim 8 wherein said means for causing movement in said outer housing comprises an elongated frame member disposed within said bank and pivotally connected to said token moving means.

10. A toy bank as defined in claim 8 wherein said outer housing is in the shape of an animal figure having a head portion including said means for receiving tokens, and wherein said means for causing movement is disposed within said head portion to cause movement around said outer housing token receiving means.

11. A toy bank as defined in claim 1 wherein a portion of said frame member is biased against said flexible upstanding wall and wherein said pawl and ratchet mechanism is actuated by forcing said outer housing inwardly, toward said frame portion thereby forcing said frame member inwardly against the bias of said upstanding wall to rotate said frame member about a pivot means thereby causing rotation of said ratchet mechanism.

12. A toy bank as defined in claim 11 wherein said ratchet mechanism includes an elongated wheel having a resilient surface.

13. A toy bank as defined in claim 11 wherein said frame member includes a U-shaped frame extension portion extending toward said outer housing for effective transmittal of force from said outer housing, through an intermediate filling material, to said frame member, for frame member rotation.

14. A toy bank, comprising:

a rigid housing defining, at least in part, a receptacle for tokens;

a plush covering on said housing;

an opening in said housing for the insertion of tokens;

an assembly for moving a token positioned in said opening into said receptacle, said assembly including a lever pivotally mounted on said housing, an engagement portion on said lever engageable to pivot said lever, a pawl on said lever, a ratchet rotatably mounted on said housing and engaged by said pawl, a cylinder secured to said ratchet and rotatably mounted on said housing, and means for holding a token against said cylinder.

15. The toy bank set forth in claim 14 further including a resilient, compressible material on said cylinder.

16. The toy bank set forth in claim 14 wherein said housing includes token receiving means for receiving a token and directing said token into said receptacle.

17. The toy bank set forth in claim 14 including means for causing movement in a predetermined area of said covering, said movement causing means being operatively connected to said lever.

* * * * *